United States Patent [19]

Samuelson

[11] Patent Number: 4,627,560

[45] Date of Patent: Dec. 9, 1986

[54] DISPENSER FOR TAPE WOUND ON THREE INCH CORES

[75] Inventor: Bruce E. Samuelson, West Lakeland Township, Washington County, Minn.

[73] Assignee: Minnesota Mining and Manufacturing Company, Saint Paul, Minn.

[21] Appl. No.: 736,255

[22] Filed: May 22, 1985

[51] Int. Cl.[4] ..... B65D 85/672

[52] U.S. Cl. ..... 225/66; 225/25; 225/65

[58] Field of Search ..... 225/66, 65, 56, 47, 225/46, 25, 26

[56] References Cited

U.S. PATENT DOCUMENTS

| | | | |
|---|---|---|---|
| 2,790,609 | 4/1957 | Hawthorne et al. | 225/26 |
| 3,170,613 | 2/1965 | Casey | 225/66 |
| 3,417,935 | 12/1968 | Douglas et al. | 225/66 X |
| 3,972,459 | 8/1976 | Cooper | 225/66 X |
| 4,358,328 | 11/1982 | Pearson | 156/73.1 |
| 4,401,248 | 8/1983 | Helms | 225/47 |

*Primary Examiner*—Frank T. Yost

*Attorney, Agent, or Firm*—Donald M. Sell; James A. Smith; William L. Huebsch

[57] ABSTRACT

A tape dispenser comprising a frame having a tape guide portion with a cutter blade at its outer edge, side wall portions attached to opposite edges of the guide portion and projecting past an inner end of the guide portion, and opposed arcuate hub portions attached to and projecting inwardly from the side wall portions in positions spaced from the guide portion. The hub portions are adapted to support a roll of pressure sensitive adhesive coated tape having a three inch diameter central opening and are adapted to mechanically interlock to rigidify the dispenser when tape is pulled from the roll along the guide portion and the cutter blade is used to cut the tape.

3 Claims, 3 Drawing Figures

DISPENSER FOR TAPE WOUND ON THREE INCH CORES

FIELD OF THE INVENTION

This invention relates to simple tape dispensers made of polymeric material from which tape may be dispensed and by which the dispensed tape may be severed from tape remaining in the dispenser.

DESCRIPTION OF THE PRIOR ART

The art is replete with simple tape dispensers of the type described above. U.S. Pat. No. 4,358,328 describes one such tape dispenser comprising a frame including a guide portion having a generally planar tape guide surface, side wall portions attached to opposite edges of the guide portion and projecting past an inner end of the guide portion, and arcuate hub portions attached to and projecting inwardly from the side wall portions at opposed positions spaced from the guide portion. The hub portions are adapted to rotatably support a roll of pressure sensitive adhesive coated tape with the periphery of the roll spaced from the inner end of the guide portion, and means for cutting the tape in the form of a cutter blade is disposed along the outer end of the guide portion so that tape can be pulled from the roll around the inner end of the guide portion and along the guide surface, and when a desired length of tape has thus been dispensed, it may be severed with the cutter blade.

While that dispenser works very well to dispense tape wound on a core having a 3.8 centimeter or 1½ inch diameter central opening, versions of that dispenser sized to dispense tape wound on cores having a three inch diameter central opening have been found to be quite unstable when used to dispense or cut tape, particularly where the tape is difficult to cut (e.g., such as ¾ inch wide filament tape available from Minnesota Mining and Manufacturing Company, Saint Paul, Minn.).

SUMMARY OF THE INVENTION

The present invention provides an improved dispenser of the type described above which does provide the stability needed to dispense and cut tapes rolled on cores having three inch diameter openings, even when the tape is difficult to cut.

According to the present invention there is provided an improved tape dispenser of the type described above adapted to support a roll of pressure sensitive adhesive coated tape having a three inch diameter central opening, in which the hub portions have parts adapted to engage each other to restrict relative movement of the hub portions in a direction parallel to the axis of the hub portions. Preferably this is done by providing a rib projecting generally at a right angle to the axis on one of the hub portions and walls defining a slot adapted to receive the rib on the other of the hub portions in close fitting relationship, and making the side wall portions resiliently bendable to facilitate positioning the rib in the slot to rigidify the dispenser when it is being used to dispense tape, or removing the rib from the slot when a new roll of tape is to be positioned around the hub portions or an empty core is to be removed.

BRIEF DESCRIPTION OF THE DRAWING

The present invention will be further described with reference to the accompanying drawing wherein like numbers refer to like parts in the several views, and wherein.

DESCRIPTION OF THE PREFERRED EMBODIMENT

Figure 1:
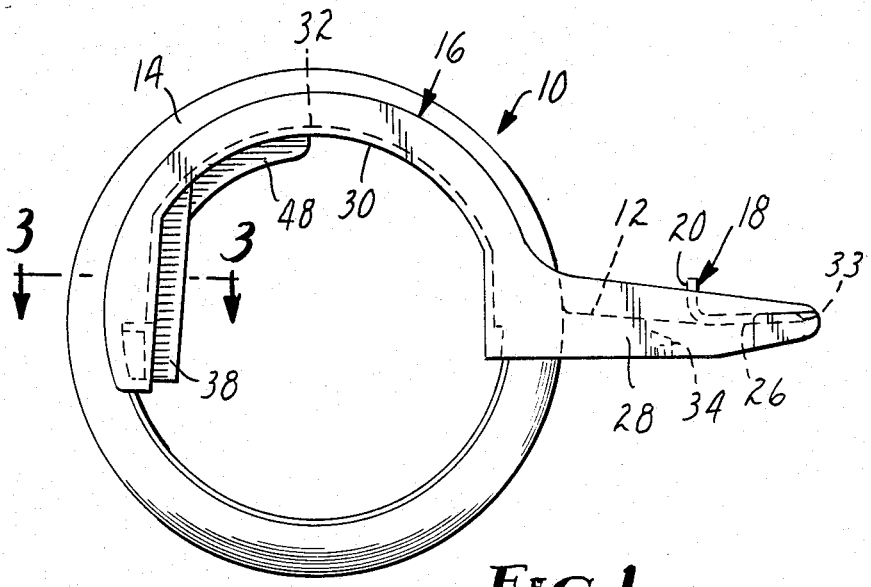
FIG. 1 is a side view of a tape dispenser according to the present invention having a roll of tape positioned around hub portions of the dispenser.

Referring now to the drawing there is shown a tape dispenser according to the present invention, generally designated by the reference numeral 10. The tape dispenser 10 is adapted to be hand held and used to dispense a length of pressure sensitive adhesive coated tape 12 from a roll 14 of the tape 12 wound on a core having a three inch diameter inner opening, and to then cut the dispensed length of tape 12 from a supply of the tape 12 remaining in the dispenser 10.

The tape dispenser 10 comprises a frame 16 including a tape guide portion 18 having inner and outer ends 20 and 22, opposite edges extending between the ends 20 and 22, and a generally planar tape guide surface 26. The dispenser 10 also includes generally planar side wall portions 28 attached along the opposite edges of the guide portion 18, disposed at about a right angle to the guide surface 26, and projecting past the inner end 20 of the guide portion 18; and arcuate hub portions 30 attached to and projecting inwardly from generally C-shaped parts of the side wall portions 28 in opposed positions spaced from the guide portion 18. The hub portions 30 have arcuate surfaces 32 adapted to support the roll 14 of pressure sensitive adhesive coated tape 12 for rotation about the hub portions 30 with the periphery of the roll 14 spaced from the inner end of the guide portion 18, and the generally C-shaped parts of the side wall portions 28 project radially above the arcuate surfaces 32 and provide edge flanges to keep the roll 14 in position around the hub portions 30. Means for cutting the tape 12 in the form of a cutter blade 33 is disposed along the outer end 22 of the guide portion 18 so that tape 12 can be pulled from the roll 14, around the inner end 20 of the tape guide portion 18, and along the tape guide surface 26 under opposed tabs 34 projecting from the side wall portions 28 which help maintain the cut end of the tape 12 adjacent the guide surface 26 and out of contact with the surface of the roll 14 when the dispenser 10 is not in use. When a desired length of the tape 12 has thus been dispensed (either by manually pulling the tape 12 from the dispenser 10 or pulling the dispenser 10 along a surface to which an end portion of the tape 12 has been adhered) the dispensed length may be severed from tape 12 in the dispenser 10 by manually manipulating the dispenser to bring the cutter blade 32 into cutting engagement with the tape 12.

The dispenser 10 described herein is particularly adapted to support a roll 14 of pressure sensitive adhesive coated tape 12 having a three inch diameter central opening in that the hub portions 30 have parts adapted to engage to restrict relative movement of the hub portions 30 in a direction parallel to their axis when tape is being dispensed from or cut by the dispenser 10. One of the hub portions 30 has a rib 36 projecting radially inwardly generally at a right angle to its axis from a part of that hub portion 30 diametrically opposite its part adjacent the guide portion 18, and the other of the hub portions 30 includes walls 38 defining a slot adapted to receive the rib 36 in close fitting relationship. The hub portions 30 and the side wall portions 28 are resiliently bendable to facilitate inserting the rib 36 in the slot defined by the walls 38 to lock the hub portions 30 together for use of the dispenser, or to remove the rib 36 from the slot to facilitate placing a new roll of tape around the hub portions 30 or removing an empty core, which insertion or removal may be easily done when a roll of tape or tape core is positioned around the hub portions 30. The bending of the hub and side wall portions 30 and 28 needed to insert the rib 36 in the groove is facilitated in that the arcuate generally C-shaped parts of the side wall portions 28 from which the hub portions 30 project have open centers. The rib 36 and walls 38 have tapered surfaces 40 and 42 respectively which help guide the rib 36 into the slot.

Stability of the dispenser 10 when in use to dispense tape is further enhanced by an arcuate plate 48 on each hub portion 30. One plate 48 projects from the end of the rib 36 along the inner surface of the hub portion 30 toward the support portion 20, and the other arcuate plate 48 projects from the corresponding end of the walls 38 defining the slot that receives the rib 36 also toward the support portion. When the rib 36 is engaged in the slot the two arcuate plates 48 are in face to face contact, and thus prevent the hub portions 30 from telescoping together when a user presses them toward each other during use of the dispenser 10. Also, the plates 48 project at about a 120 degree included angle from the ends of the rib 36 and walls 38 defining the slot along the inner surfaces of the hub portions 30 and help to restrict bending of the halves of the hub portions 30 furthest from the guide portion 20, thereby causing the hub and side wall portions 30 and 28 to bend generally along their entire lengths to insert the rib 36 in or remove the rib 36 from the groove.

Figure 2:
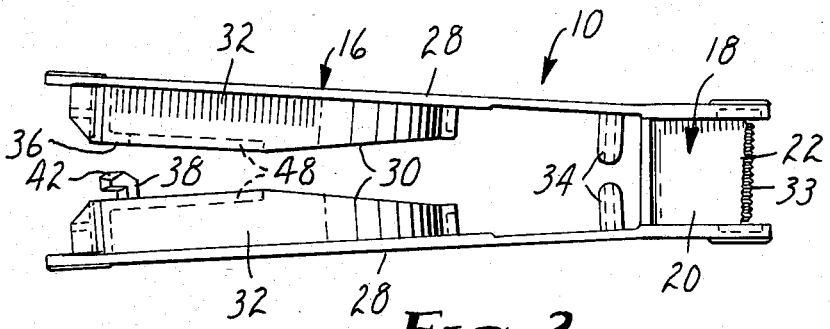
FIG. 2 is a top view of the tape dispenser of FIG. 1 having the hub portions on the dispenser separated so that a new roll of tape could be loaded onto the dispenser.
Figure 3:
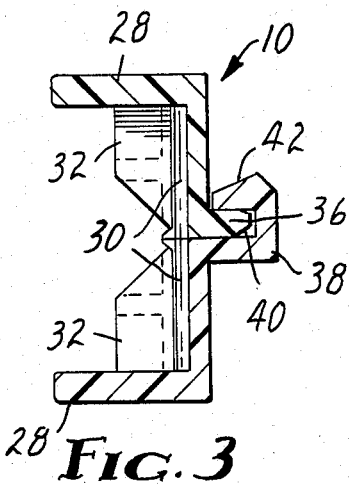
FIG. 3 is an enlarged sectional view taken approximately along line 3—3 of FIG. 1, but not illustrating the roll of tape.

The frame 16 of the dispenser 10 is preferably molded with the hub portions 30 spaced apart as illustrated in FIG. 2, from which position the hub portions 30 may be easily moved further apart by resiliently bending the side wall portions 28 to facilitate loading the roll 14 of the tape 12 into the dispenser 10 or removing an empty core; and may be moved closer together to engage the rib 36 in the slot defined by the walls 38 and thereby engage the hub portions 30 together to restrict relative movement of the hub portions 30 in a direction parallel to their axis and to provide the appropriate spacing between the side flanges that locate the roll 14 on the arcuate surfaces 32 provided by the C-shaped parts of the side wall portions 28.

Preferably the cutter blade 33 is of metal with a serrated sharpened edge and is attached by the method described in U.S. Pat. No. 4,358,328 incorporated herein by reference. Alternatively, the cutting blade could be provided by molding teeth along the outer end 22 of the guide portion 18, which molded teeth could be used for tapes that are easily severed.

The present invention has now been described with reference to one embodiment thereof. It will be apparent to those skilled in the art that many changes can be made in the embodiment described without departure from the scope of the present invention. Thus the scope of the present invention should not be limited to the structures described in this application, but only by structures described by the language of the claims and the equivalents of those structures.

I claim:

1. In a tape dispenser comprising a frame including a tape guide portion having inner and outer ends, oposite edges extending between said ends, and a generally planar tape guide surface; side wall portions attached to said opposite edges of said guide portion and including parts projecting past the inner end of said guide portion; and arcuate hub portions having an axis attached to and projecting inwardly from said parts of said side wall portions in oposed positions spaced from said guide portion, said hub portions being adapted to support a roll of pressure sensitive adhesive coated tape for rotation about said hub portions with the periphery of said roll spaced from the inner end of said guide portion; and means for cutting the tape disposed along the outer end of said guide portion; the improvement wherein said hub portions are adapted to suport a roll of pressure sensitive adhesive coated tape having a three inch diameter central opening, one of said hub portions has a rib projecting at generally a right angle to said axis, and the other of said hub portions includes walls defining a slot adapted to receive said rib in a close fitting relationship, said rib and said walls defining said slot being disposed only along parts of said hub portions diametrically opposite parts of said hub portions adjacent said tape guide portion, and said hub portions and said parts of said side wall portions being resiliently bendable to facilitate positioning said rib in said slot to restrict relative movement of said hub portions in a direction parallel to said axis during use of the dispenser, and to facilitate removing said rib from said slot to change the roll of tape.

2. A tape dispenser according to claim 1 wherein said parts of the side wall portions from which said arcuate hub portions project are generally C-shaped to provide an open center for said hub portions and facilitate bending of the hub portions and side wall portions to position said rib in said slot and remove said rib from said slot.

3. A tape dispenser according to claim 2 wherein said frame further includes a first plate projecting from the rib along the inner surface of the hub portion toward said support portion, and a second plate projecting from the walls defining the slot along the inner surface of the hub portion adapted to abut said first plate and prevent telescoping of said hub portion when said rib is engaged in said slot, said plates extending only for about a 120 degree included angle from said rib walls to restrict bending of the hub portion adjacent said rib and walls and cause generally uniform bending of said hub portions and said parts of said side wall portions when said rib is inserted in and removed from said groove.

* * * * *

UNITED STATES PATENT AND TRADEMARK OFFICE

CERTIFICATE OF CORRECTION

PATENT NO. : 4,627,560

DATED : December 9, 1986

INVENTOR(S) : Bruce E. Samuelson

It is certified that error appears in the above-identified patent and that said Letters Patent is hereby corrected as shown below:

Column 4, line 12, "oposite" should read -- opposite --.

Column 4, line 19, "oposed" should read -- opposite --.

Column 4, line 56, "from said rib walls to restrict" should read -- from said rib and walls to restrict --.

Signed and Sealed this

Twenty-sixth Day of April, 1988

*Attest:*

DONALD J. QUIGG

*Attesting Officer*

*Commissioner of Patents and Trademarks*